US009317016B2

(12) United States Patent
Ruestenberg et al.

(10) Patent No.: US 9,317,016 B2
(45) Date of Patent: Apr. 19, 2016

(54) INSTRUMENT FOR COUNTING THE DURATION OF DIFFERENTIATED PHASES

(75) Inventors: Ines Ruestenberg, Riedholz (CH); Gerald Matthey, Ballaigues (CH); Fabien Balli, Meinier (CH)

(73) Assignee: Hamilton International AG, Bienne (CH)

( * ) Notice: Subject to any disclaimer, the term of this patent is extended or adjusted under 35 U.S.C. 154(b) by 0 days.

(21) Appl. No.: 14/006,862

(22) PCT Filed: Mar. 22, 2012

(86) PCT No.: PCT/EP2012/055135

§ 371 (c)(1),
(2), (4) Date: Nov. 22, 2013

(87) PCT Pub. No.: WO2012/127008

PCT Pub. Date: Sep. 27, 2012

(65) Prior Publication Data

US 2014/0064042 A1 Mar. 6, 2014

(30) Foreign Application Priority Data

Mar. 23, 2011 (EP) ..... 11159452

(51) Int. Cl.
*G04F 8/00* (2006.01)
*G04F 10/00* (2006.01)
*G07C 1/04* (2006.01)

(52) U.S. Cl.
CPC ..... *G04F 8/006* (2013.01); *G04F 10/00* (2013.01); *G07C 1/04* (2013.01)

(58) Field of Classification Search
CPC ..... G04F 10/00; G04F 1/005; G04F 8/006; G04F 8/00; G07C 1/22
USPC ..... 368/107, 110–113
See application file for complete search history.

(56) References Cited

U.S. PATENT DOCUMENTS 4,505,595 A * 3/1985 Rose et al. ..... 368/110
4,797,864 A * 1/1989 Stano et al. ..... 368/111

(Continued)

FOREIGN PATENT DOCUMENTS

EP 0 130 150 1/1985

OTHER PUBLICATIONS

International Search Report Issued Aug. 28, 2012 in PCT/EP12/55135 Filed Mar. 22, 2012.

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

An instrument for counting duration for differentiated phases, including: plural mechanisms for recording a time duration, each actuatable, for activation and deactivation thereof, by a first controller; a general controller for controlling, from an inactive position in which all the recording mechanisms are deactivated, activation of only one of them, selected by a selector, and for again controlling, at a final moment, deactivation of all the recording mechanisms; a switch configured, during a command for activation of one of the recording mechanisms, to trigger the deactivation of all other recording mechanisms and to save totality of the recorded times, counted on each of the recording mechanisms. The selector is configured to be controlled by a user or/and by a measuring mechanism or/and by a signal to trigger the activation of one of the recording mechanisms.

23 Claims, 4 Drawing Sheets

(56) References Cited

U.S. PATENT DOCUMENTS

| | | | | |
|---|---|---|---|---|
| 5,297,110 | A | 3/1994 | Ohira et al. | |
| 5,408,446 | A | 4/1995 | Ohira | |
| 5,796,681 | A * | 8/1998 | Aronzo | 368/10 |
| 5,854,774 | A * | 12/1998 | Timme | 368/10 |
| 6,904,001 | B1 * | 6/2005 | Rast | 368/71 |
| 6,975,563 | B2 * | 12/2005 | de Brito | 368/109 |
| 7,167,418 | B2 * | 1/2007 | Hallberg | 368/107 |
| 7,426,157 | B2 * | 9/2008 | Arnold et al. | 368/82 |
| 2003/0021189 | A1 * | 1/2003 | Streja | 368/62 |
| 2004/0008589 | A1 * | 1/2004 | McMillan et al. | 368/223 |
| 2005/0276165 | A1 | 12/2005 | Chien | |
| 2007/0247976 | A1 * | 10/2007 | Capozzi et al. | 368/82 |

* cited by examiner

INSTRUMENT FOR COUNTING THE DURATION OF DIFFERENTIATED PHASES

CROSS-REFERENCE TO RELATED APPLICATIONS

This is a National Phase Application in the United States of International Patent Application PCT/EP2012/055135 filed Mar. 22, 2012 which claims priority on European Patent Application No. 11159452.9 filed Mar. 23, 2011. The entire disclosures of the above patent application are hereby incorporated by reference.

The present invention relates to an instrument for counting the duration for differentiated phases, comprising a plurality of means for recording a time duration, each actuatable, for activation and deactivation thereof, by a control means, said instrument comprising a general control means for controlling, from an inactive position where all said recording means are deactivated, the activation of only one of them, selected by selection means which said instrument comprises, and for again controlling, at a final moment, the deactivation of all said recording means whilst memorising the recorded data.

TECHNOLOGICAL BACKGROUND

It is known that timepieces can be used by pilots when they are flying. In fact, for each flight, pilots must be able to define precisely their flight time in order to fill in their logbook precisely, in order to comply with their flight plan and to calculate precisely their recovery time. This knowledge of the flight time is indispensable for calculating the fuel range. In fact, in aviation, the range is indicated in time so that if the pilot knows his consumption, the flight time and the quantity of fuel which he is carrying, he can easily know his range. For example, if the pilot knows that his aircraft is carrying 400 l of fuel plus the legal reserve, that at the maximum speed he consumes 100 l/hour, he knows that he will have consumed all his fuel at the end of 4 h and will therefore have to land his aircraft before expiry of these 4 h without using the legal reserve. Hence, if the pilot knows that he has flown for 2 h30 at the maximum speed, he knows that he still has 1 h30 of flight.

Watches exist which can record the flight logbook of the pilot, i.e. from the time of ignition of the engine of the aircraft until stoppage of the engine after landing. One of these watches comprises an electronic clock movement and also display means and control means. The temporal information provided by the electronic clock movement is displayed via the display means. When the engine of the aircraft is started up, the pilot activates the control means so that the time of start-up of the engine is memorised by the electronic clock movement, the latter comprising a calculation unit and a memory. Then, subsequent activations of the control means make it possible to memorise other information, such as the time of take-off, landing, switching-off of the engine, or even to take into account the stopovers during the flight. For this reason, the user knows the time and the duration of all the major events of his flight and can take them into account.

Now, one disadvantage is that this watch cannot calculate the duration of a plurality of different phases in series, such as for example the various phases of a flight. In fact, it can be advantageous for a pilot to know the duration of a first flight phase and the duration of a second flight phase. The most common flight phases are the visual VFR flight (for visual flight rules) and the instrument IFR flight (for instrument flight rules).

Visual flight is characterised in that the pilot has a clear view beyond the horizon so that he can anticipate easily anything that might happen. By contrast, instrument flight is characterised when the pilot cannot anticipate events solely with his eyes. This can occur at night or during inclement fog or flight in clouds. The pilot has to rely on his flight instruments alone, which makes these IFR flight phases tiring because extreme concentration is required.

Consequently, it can be assumed that the inactive times which are necessary will be different depending on whether the pilot has been engaged in a visual flight or an instrument flight.

Now, this possibility does not exist in prior art and no timepiece proposes this function of calculating the duration of various flight phases.

SUMMARY OF THE INVENTION

The object of the invention is to remedy the disadvantages of the prior art by proposing to provide a timepiece which is able to count the flight time for at least two different phases whilst being readable and simple to use.

To this end, the invention relates to an instrument for counting the duration for differentiated phases, comprising a plurality of means for recording a time duration, each actuatable, for activation and deactivation thereof, by a first control means. The instrument comprises a general control means for controlling, from an inactive position where all said recording means are deactivated, the activation of only one of them, selected by selection means which said instrument comprises, and again controlling, at a final moment, the deactivation of all said recording means. The instrument comprises switching means which are designed, during a command for activation of one of said recording means, to trigger the deactivation of all the other recording means and to save the totality of the recorded times, counted on each of said recording means, said selection means being designed to be controlled by a user or/and by measuring means or/and by a signal in order to trigger the activation of one of said recording means, and in that each of said recording means is designed, during a reactivation, to resume the counting of the duration from the total duration recorded by said recording means.

A first advantage of the present invention is having an instrument which is able to calculate the duration of various phases of an event and to display, in a readable manner, when the event is finished, the duration of these phases of the flight time. In fact, the present invention is designed so that the duration of each flight phase is calculated and also the total time of the event is calculated and displayed. This makes it possible for the pilot to identify easily in which flight phase he finds himself and without confusion about his flight time.

Another advantage of the present invention is that handling this instrument is simple. The present invention makes it possible to activate easily calculation of the flight time of the various phases. Effectively, after activation of the calculation of the time duration, an action on the control means of the timepiece makes it possible to switch over automatically calculation of the duration of one phase to another.

In a first advantageous embodiment, said recording means are electronic counters controlled by an electronic circuit.

In a second advantageous embodiment, the total duration of the various phases between the moment of general activation and the moment of general deactivation is displayed on display means.

In a third advantageous embodiment, the duration of at least one of the phases is displayed on display means by action on a second control means which is identical or not to the first control means.

In a fourth advantageous embodiment, said instrument is a timepiece and in that the electronic circuit is a clock movement.

In another advantageous embodiment, the display means comprise a first display unit on which the total duration of the various phases between the moment of general activation and the moment of general deactivation and/or the duration counted for each phase is displayed.

In another advantageous embodiment, the display means comprise in addition a second display unit on which the phase corresponding to said recording means is indicated.

In another advantageous embodiment, said instrument comprises two recording means and a number of display units equal to the number of recording means on each of which the duration counted by a recording means when the latter is activated is displayed.

In another advantageous embodiment, the display units are digital.

In another advantageous embodiment, the display means comprise in addition a total display unit displaying the total duration counted from the activation of a recording means by the action of the general control means.

In another advantageous embodiment, the general control means is a push button.

In another advantageous embodiment, the first control means are a push button.

In another advantageous embodiment, the selection means are a rotatable element.

In another advantageous embodiment, said rotatable element is the turning bezel of the timepiece.

In another advantageous embodiment, the first control means are a touch key.

In another advantageous embodiment, said instrument comprises a first control means by differentiated phase, in order, during a command for activation of one of said recording means, to trigger the deactivation of all the other recording means and to save the totality of the recorded time counted on each of said recording means.

In another advantageous embodiment, the two display units are analogue, each comprising a hand.

In another advantageous embodiment, the total duration of the various phases between the moment of general activation and the moment of general deactivation is displayed on the first display unit.

The invention likewise proposes providing a method for counting the duration for the differentiated phases of a plurality of means for recording a time duration, each actuatable, for activation and deactivation thereof, by a first control means, said method comprising the following steps:

selecting, in an inactive position where all said recording means are deactivated and via selection means which said instrument comprises, one of the recording means;

controlling, by action of a general control means, the activation of the selected recording means and displaying, on display means, the counting of the time duration provided by this recording means;

actuating the switching means in order to control the activation of one of said recording means, triggering the deactivation of all the other recording means and saving the totality of the recorded time counted on each of said recording means, each of said recording means being designed, during a reactivation, to resume counting of the duration from the total duration recorded by said recording means;

controlling the deactivation of all said recording means.

In an advantageous embodiment of this method, this method comprises in addition the step consisting of displaying, on display means, the duration of at least one of the phases and is by action on a second control means which is identical or not to the first control means.

In an advantageous embodiment of this method, this method comprises in addition the step consisting of displaying the total duration of the various phases between the moment of general activation and the moment of general deactivation and is displayed on display means.

BRIEF DESCRIPTION OF THE FIGURES

The aims, advantages and features of the instrument according to the present invention will appear more clearly in the following detailed description of at least one embodiment of the invention which is given solely by way of example, non-limiting and illustrated by the attached drawings in which.

DETAILED DESCRIPTION

Figure 1:
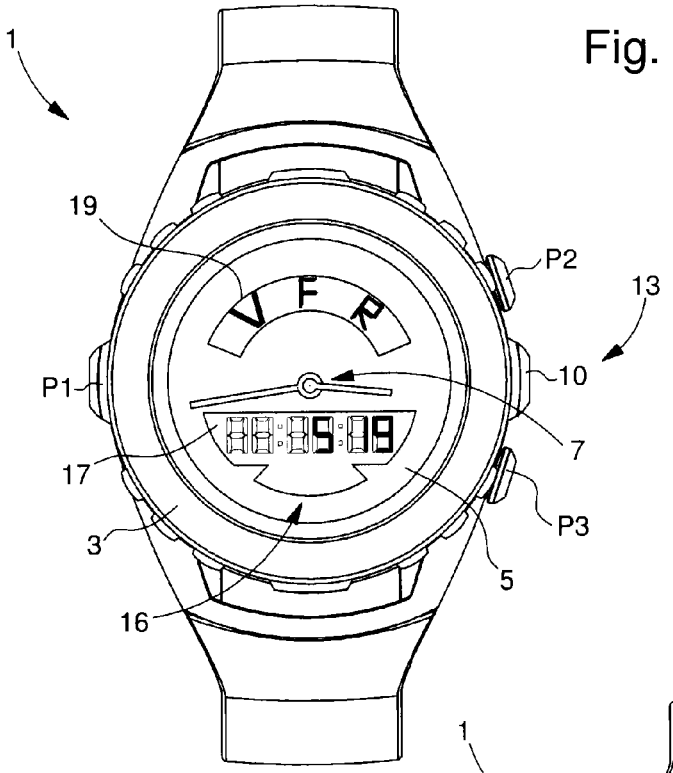
FIGS. 1 and 2 represent schematically a view from above of the instrument according to the present invention with digital displays.

The instrument according to the present invention is represented in FIG. 1. This instrument is for example a timepiece 1. This timepiece 1 comprises a case 3 closed by a base and a glass. This timepiece comprises in addition a dial 5 provided under the glass and on which temporal information is displayed. This information can be information about the time and/or information associated with a chronographical function. Information about the time is preferably displayed via analogue or digital reading means 7. The information associated with functions other than the standard time are displayed via analogue or digital display means 16. This timepiece comprises in addition a clock movement. This clock movement 9 is present in the form of an electronic circuit and comprises recording means 11. Each recording means 11 is present in the form of a counter providing time information. The recording means 11 are connected to a switching means 15 which is controlled by the first control means 13. This time information is displayed on the dial 5 on display means 16. In the non-limiting example of the present description, an electronic clock movement is used. This electronic clock circuit 9 is thus designed to have a chronographical function.

According to the invention, the electronic clock movement 9 is programmed to integrate a function for calculating a flight time for various types of flight. Of course, the example described in this description is not limiting.

Figure 2:
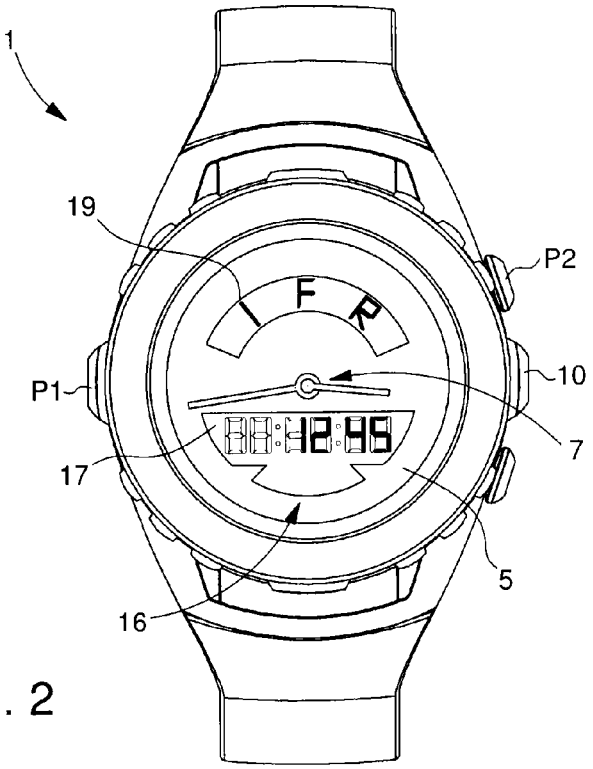
Figure 5:
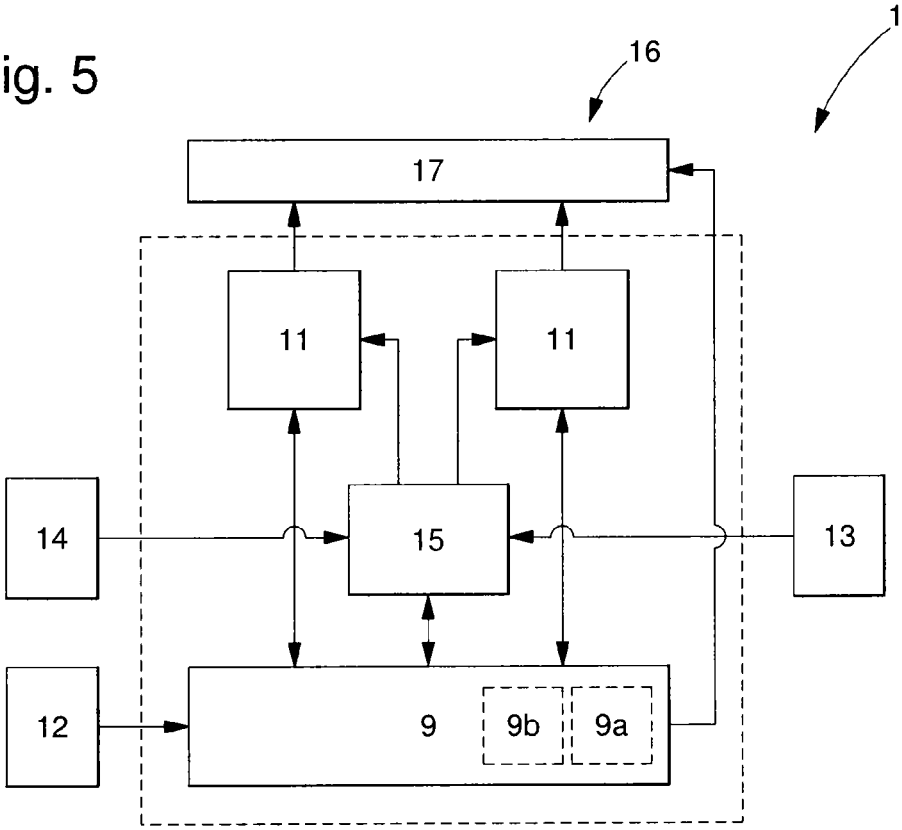
FIG. 5 represents schematically the instrument 1 according to a first embodiment of the present invention.

In a first embodiment represented in FIGS. 1, 2 and 5, the instrument comprises a single control means P2 situated at 1 h for all the recording means 11. The instrument 1 comprises a crown wheel 10 at 3 h for setting the time and a general control means 12 such as a push button P2 at 10 h. The example of two distinct flight types is: visual flight termed VHR (for visual flight rules) and instrument flight termed IFR (for instrument flight rules). The instrument 1 therefore comprises two counters 11, one for each flight phase.

The dial 5 of the timepiece 1 bears display means 16 which comprise two digital display units 17, 19. The first digital display unit 17 is used to indicate the total flight time calculated by the clock movement, i.e. by the electronic circuit 9, during implementation of the function for calculating the flight time.

During operation of this instrument 1, the first step consists of activating the function by action on the general control means 12. In this first embodiment, activation of the function is effected by the pilot by pressing on the push button P1 situated at 10 h. This push P1 serves as general control means 12. The flight logbook function is then activated and the first display unit 17 begins to display the flight time and the recording means 11 which is dedicated to the VFR flight counts the VFR flight time without displaying it. By default, the second display unit 19 indicates that the VFR flight phase is the phase, the duration of which is being recorded. The displayed information is produced by the counter 11 which is dedicated to visual flight. The user takes off and flies in accordance with his flight plan.

Of course, the type of flight displayed by default can be chosen in advance by the pilot via the selection means 14. This makes it possible to start the calculation of the flight time for the desired flight phase. These selection means 14 can be a push button P3 situated at 4 h and act on the switching means 15 connected to the recording means 11 in order to select the desired recording means.

When the flight phase changes, i.e. when the pilot changes from a VFR flight to an IFR flight, the pilot presses on the push button P2, i.e. on the first control means 13.

This pressure causes stoppage, deactivation of the recording means 11 which is dedicated to the calculation of the flight time corresponding to the VFR visual flight. In fact, pressure on the push button P2 causes activation of the switching means 15 which is connected to the recording means 11 which here are counters. When they are activated, these switching means 15 automatically switch the recording means 11 so that the recording means 11 whilst functioning is stopped when the recording means 11 which was deactivated is started up. This operation is effected without the display of the total flight time being stopped. Thus, in the present example, the counter 11 which is dedicated to the calculation of the VFR flight time is stopped, its value is saved in a memory space 9*a* which is dedicated to the VFR visual flight of the electronic circuit 9. At the same moment, the counter 11 which is responsible for calculation of the IFR flight time is activated or started up. The second display unit 19 then indicates the new phase.

When the pilot again changes the flight phase, i.e. when he changes from an IFR phase to a VFR phase, he again presses on the push button P2. This push button P2 acts on the switching means 15 which automatically switch over the recording means 11. This causes stoppage of the recording means 11 whilst functioning and saves it in a memory space 9*b* which is dedicated to the IFR instrument flight of the electronic circuit 9, of the calculated value. The recording means 11 which is inactive, i.e. the counter dedicated to the visual VFR flight is activated again, started up. The calculation is then resumed so that the time of the visual VFR flight is recorded once again.

During landing, the pilot presses on the general control means 12, i.e. on the push button P1, in order to stop the function of calculation of the flight time. This pressure automatically causes stoppage of the counting of the flight time in operation, i.e. stoppage of the active counter 11, all the counters 11 are then inactive. The saved times for the time of the visual VFR flight are added together and the saved times for the time of instrument IFR flight are added together. The result of each addition is memorised in the electronic circuit 9. The counting of the total flight time is likewise stopped.

Then, by action on second control means which can be or not the first control means 13, the user switches the display in order to display, on the first display unit 17, the results of each flight phase.

It is conceivable that said instrument 1 is provided with a supplementary digital screen of the LCD type so as to display intermediate values. This makes it possible to display, in addition to the flight time, the time calculated for each phase. This supplementary screen displays alternately the duration of each phase.

This first embodiment allows good readability of the information since there is only information about the total flight time which is displayed. Therefore any risk of confusion which could prove to be serious is avoided.

Figure 3:
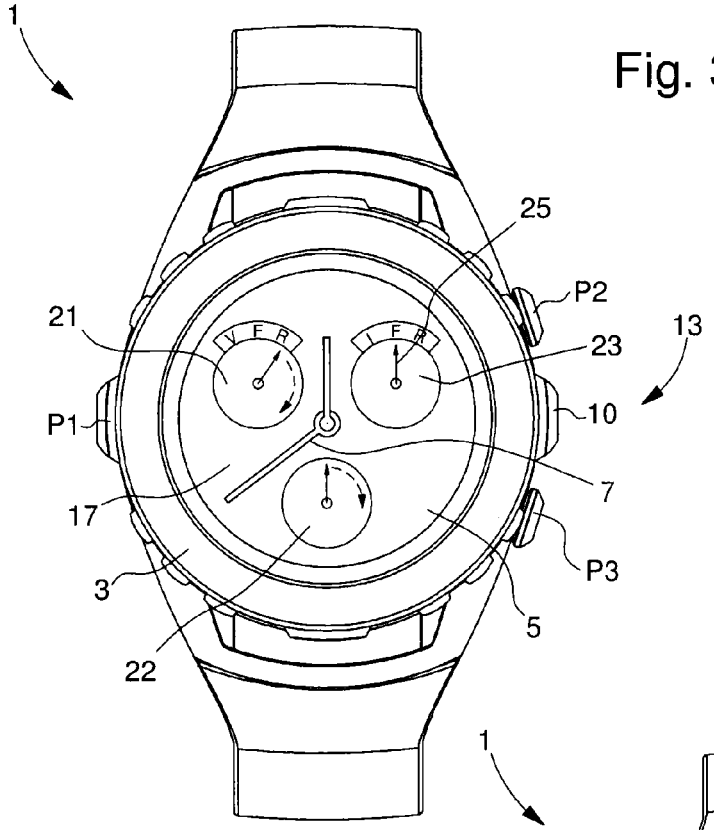
FIGS. 3 and 4 represent schematically a view from above of the instrument according to the present invention with analogue displays.
Figure 4:
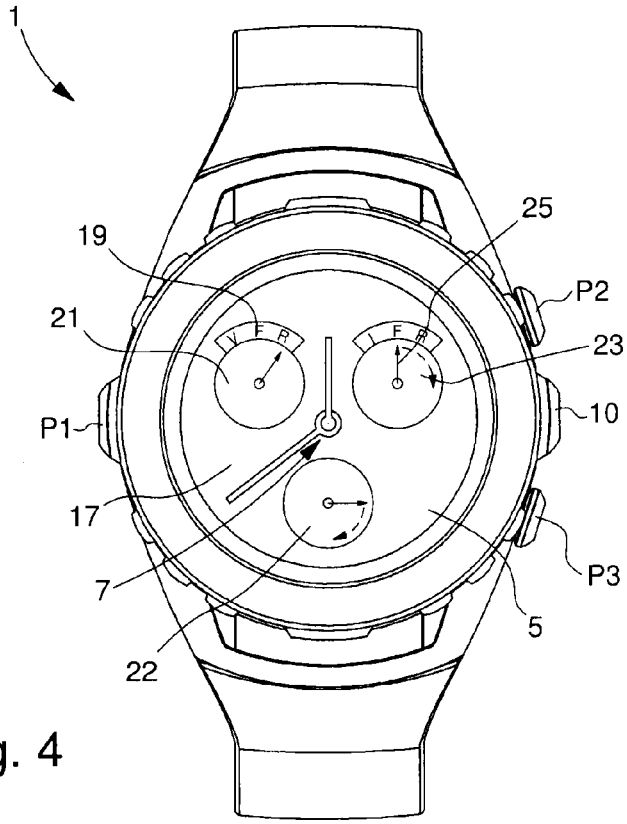

In a variant represented in FIGS. 3 and 4, the dial 5 of the instrument 1 comprises three analogue display units 21, 22 and 23. On the three analogue display units 21, 22 and 23, markings are provided in order to indicate a duration, such as for example minutes or hours. The display units 21, 23 are each dedicated to one type of flight: the display unit 21 for the VFR flight and the display unit 23 for the IFR flight. Each display unit 21, 23 comprises a hand 25, the rotation of which is controlled by the electronic circuit 9 in order to point to the counted value. The display unit 22 is used to indicate the total flight time. It is therefore understood that the electronic circuit 9 sends signals to each motor in order to actuate them and thus to make the corresponding hand 25 turn.

The general control means 12 are designed to activate this function.

During operation of this instrument 1, the first step consists of activating the function by pressure on the push button P1 situated at 10 h. The flight logbook function is started up and the first counter begins to count and the result is displayed on a display unit, here on the display unit of the VFR flight 21.

In a second step, the pilot enters into a flight phase where he must fly with the help of instruments, i.e. where he enters into a flight phase in which the visibility conditions are poor. From that time on, he records the flight time with IFR instruments. For that, he presses on the push button P2, the push button situated at 1 h, so that the switching means 15 automatically switch over the recording means 11. This switching has the effect that the first counter 11 which is dedicated to the VFR phase and the corresponding display unit 21 are stopped. The second counter 11 which is associated with the IFR flight phase starts up and the calculated duration is displayed on the display unit of the IFR flight 23. The counting of the total flight time is not therefore interrupted and it continues to be displayed on the display unit 22.

When the pilot changes back into a flight phase in which he can, once again, anticipate and perform a visual flight, he actuates again the push button P2. The consequence is that the counter 11 which is dedicated to the IFR flight and its display unit 23 are stopped. The counter 11 which is dedicated to the counting of the VFR flight duration is restarted and the associated hand 25 is moved again in order to indicate the time for the IFR condition flight.

When the pilot lands, he actuates the push button P1 in order to stop the counters 11. The hands 25 of the two display units 21, 23 are stopped and indicate, consequently, the total time for the IFR flight and for the VFR flight. The pilot therefore knows precisely how much time he has spent on visual flight and how much time he has spent on instrument flight in addition to knowing the total flight time. This variant makes it possible therefore to have a view of the entirety of the flight phases and also a view of the entirety of the flight time.

It can be conceived that the passage from one phase to the other is controlled by a measuring means, such as a light sensor or simply by a radio signal which gives information that the phase change must take place. Likewise, it is conceivable that the passage from one phase to another is controlled by an altimetric sensor which switches from one phase to the other when the pilot crosses a certain threshold. This works also with a temperature sensor.

In another variant, the counters 11 and the display units 21, 23 are reset to zero during each phase change. There is meant by this that the hand 25 which is stopped before the switch to another phase is reset to zero. Thus, when the pilot again switches to this phase, the hand 25 restarts from a zero position. This configuration allows the pilot to know the time of each phase, the total time of each phase being provided upon landing.

In another variant, the counters 11 and the display units 21, 23 are not reset to zero immediately after switching the display unit from one flight phase to another. Resetting to zero only occurs when the pilot switches again over to the initial flight phase of VFR flight. For example, the pilot finds himself in a VFR flight phase and the time is counted. Then, he changes to an IFR flight phase and then switches the display. The display unit of the VFR flight 21 is stopped and the display unit 23 which is dedicated to the IFR flight is engaged. However, the display unit 21 which is dedicated to the VFR flight is not reset to zero. When the pilot changes from the IFR flight phase to the VFR flight phase, the display unit of the IFR flight 23 is stopped, the display unit 21 which is dedicated to the VFR flight is instantaneously reset to zero then engaged so that the VFR flight time is recorded. This variant makes it possible always to have in mind the flight time of the preceding phase.

In another variant the two counters are digital screens of the LCD type which are able to be equipped with backlighting in order to improve night visibility of the information. These digital screens are of the LCD type. The information can be digital or be pseudo-digital with a screen simulating an analogue display unit. Likewise, it is conceivable that these two counters are simply a single counter comprising two distinct zones.

In a second embodiment, the instrument 1 is designed to calculate the duration of a number of phases greater than two, such as for example visual flight, instrument flight, automatic pilot flight and ocean flight. The instrument 1 then comprises four recording means 11, i.e. four counters. Let us consider here the example where the instrument 1 comprises a first display unit 17 for the total flight duration and a second display unit 19 for indicating to the pilot the corresponding phase. The selection means 14 are used in order to choose the initial phase and to allow the user to choose the phase to which he wants to switch. Effectively, in the case where the instrument 1 is used in order to calculate the duration of two phases, the switching means 15 are a simple switch. This switch-makes it possible to engage the counter of the desired phase whilst disengaging the counter 11 from functioning. For a number of phases greater than two, a switch cannot be used. Selection means are used in order to choose the phase into which one wishes to enter. The first control means 13 consequently act on the switching means 15 in order to switch the instrument 1 so that the recording means 11, corresponding to the selected phase, is engaged and that the other recording means 11 are stopped.

The selection means 14 of this second embodiment can be present in the form of a rotatable button, such as a potentiometer or a switch with several positions. The turning bezel can be used as selection means 14.

The user begins by selecting, with the help of selection means 14, the phase with which to begin. This selection takes place by rotation of a button. For example, the pilot begins by flying in the visual flight phase. Once the function of calculating the time duration is activated by pressure on the push button P1, the selected counter 11 starts up whilst the first display unit 17 indicates the duration of the total flight time, this duration being calculated by the electronic circuit 9 serving as clock movement.

When a phase change occurs, the user begins by selecting, via the selection means 14, the phase into which he wants to enter. For example he wants to enter into the oceanic flight phase. He acts on the selection means 14 by turning the corresponding button in order to point to the oceanic flight phase. Once a selection has been made, the pilot presses on the first control means 13, i.e. the push button P2. This pressure causes activation of the switching means 15. The counter 11 which is dedicated to visual flight is automatically stopped whilst the display of the total flight time continues. The counted value is saved in a memory space 9*a*. The selected counter 11, i.e. the one which is dedicated to the oceanic flight is automatically engaged in order to count the duration of the oceanic phase flight. The second display unit 19 indicates the new selected phase so that the pilot is able to know in which phase he finds himself.

The same operation is implemented for each phase change.

When the flight is finished, the pilot engages the push button P1 and all the counters 11 are stopped. The various results are then added together and the pilot can use the selection means 14 and the first control means 13 in order to display the various results on the display means 16.

Figure 6:
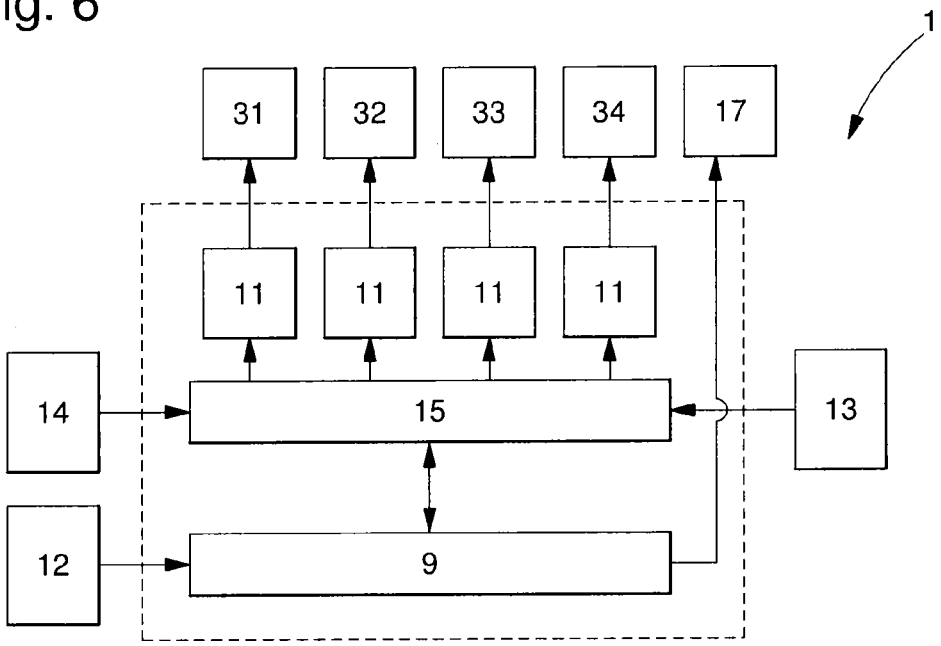
FIG. 6 represents schematically the instrument 1 according to a second embodiment of the present invention.

In a first variant which can be seen in FIG. 6, the display means 16 comprise in addition a display unit for each phase, in addition to the display unit 17 which is dedicated to the total flight time. In the case of four flight phases, the display means 16 comprise four display units 31, 32, 33 and 34.

When a phase change takes place, the user begins by selecting, via the selection means 14, the phase into which he wants to enter. For example he wants to enter the oceanic flight phase. He acts on the selection means 14 by turning the corresponding button in order to point to the oceanic flight phase. Once this selection has been made, the pilot presses on the first control means 13, i.e. the push button P2. This pressure causes activation of the switching means 15. The switching means 15 act so that the counter 11 which is dedicated to visual flight is stopped, so that one of the corresponding display units 31, 32, 33 or 34 is stopped. The selected counter 11, i.e. the latter which is dedicated to the oceanic flight is automatically engaged. The result of the calculation of the duration of the counter 11 is sent to one of the display units 31, 32, 33 or 34 which is dedicated to the oceanic flight phase.

Figure 7:
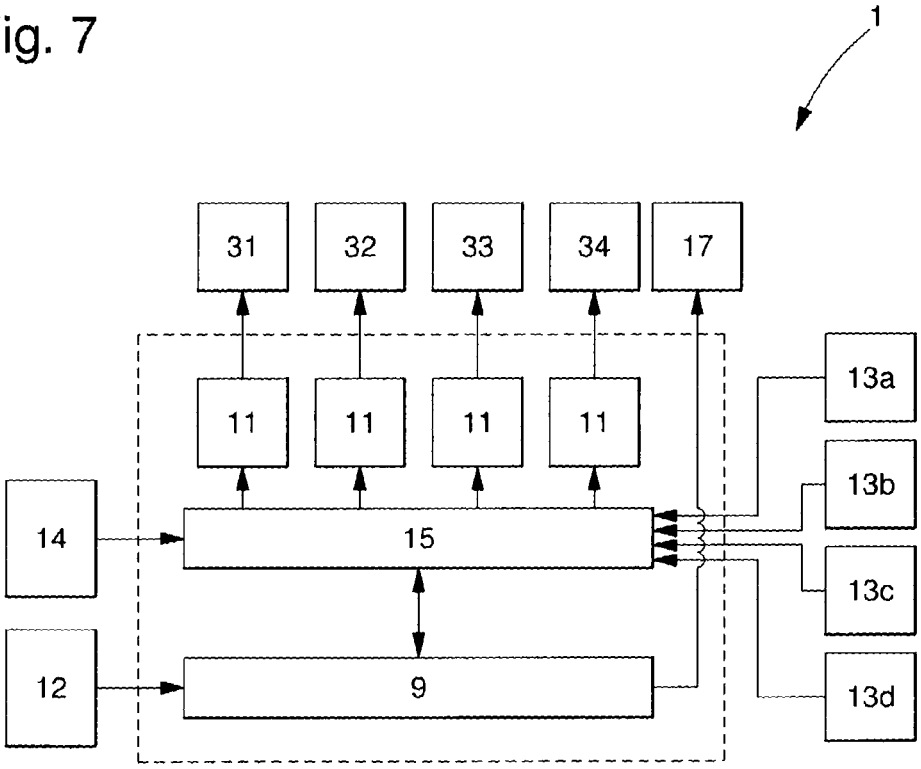
FIG. 7 represents schematically a variant of the instrument 1 according to the second embodiment of the present invention.

In a second variant which can be seen in FIG. 7, the selection means 14 and the first control means 13 are identical. In fact, it is conceivable that the instrument is equipped with a control means by phase, in the case of four phases, the instrument 1 comprises four control means 13*a*, 13*b*, 13*c*, 13*d*. Consequently, pressure on one of the control means 13*a*, 13*b*, 13*c*, 13*d*, corresponding to one phase, causes switching of the instrument 1 so that the counter 11 associated with the control phase is started up whilst all the other counters are automatically stopped.

If each phase is associated with one of the display units 31, 32, 33, 34, switching from one phase to another automatically causes stoppage of one of the display units 31, 32, 33, 34 which is associated with the stopped phase and activation of one of the display units 31, 32, 33, 34 which is dedicated to the phase which is started up.

In contrast, if there is only one single display unit 17 for all the phases, the latter displays the total flight time and pressure on one of the control means 13*a*, 13*b*, 13*c*, 13*d* which engages the corresponding phase meaning that the duration of the preceding phase is saved in the electronic circuit 9. The display of the total durations of each flight phase is effected at the end of the flight when the function of calculating the flight time is deactivated.

Of course, it will be understood that the instrument 1 can be a totally mechanical timepiece, the switching means 15 being present in the form of a coupling system which is produced in order to switch between the various recording means. In the case of two counters for a single display unit, this coupling system can consist, for example, of two wheel trains each connecting counters to the gearing of the display unit. The coupling system comprises in addition a coupling element at the level of the gearing of the display unit so that pressure on the control means 13 causes activation of this coupling. This coupling therefore connects the inactive gear train to the gearing of the display unit. The gear train cooperating with the gearing of the display unit becomes inactive. It acts therefore like a switch.

It will be understood that various modifications and/or improvements and/or combinations which are evident to the person skilled in the art can be applied to the various embodiments of the invention explained above without extending beyond the scope of the invention defined by the attached claims.

The instrument 1 can likewise comprise a supplementary display unit in order to display the number of the flight. In fact, it can be provided that the instrument is able to memorise each flight, i.e. the data of each phase between two presses on the general control means. This makes it possible to save the values for a certain time in order that the pilot is not obliged to fill in his flight logbook immediately after the end of his flight.

Furthermore, it can be imagined that this instrument is used in order to calculate the time a user needs to play a hole in a round of golf. Thus at each hole, the user changes phase and the duration of said phase is measured.

Likewise, it could be imagined that this instrument does not calculate the duration of each hole but the number of necessary strokes. The recording means are then counters and are activated by a gyroscope or an accelerometer which detects a swing.

The invention claimed is:

1. An instrument for counting duration for differentiated phases, comprising:

a first control mechanism;

a plurality of recording mechanisms to count time and to record a time duration, each actuatable, for activation and deactivation thereof, by the first control mechanism;

a selection mechanism that is a single actuator, each of the recording mechanisms being selectable by the selection mechanism;

a general control mechanism to control, from an inactive position in which all the recording mechanisms are deactivated, activation of only one of the recording mechanisms selected by the selection mechanism, and to again control, at a final moment, deactivation of all the recording mechanisms; and a switching mechanism configured, during a command for activation of one of the recording mechanisms, to trigger the deactivation of all other recording mechanisms and saving of a totality of recorded times, counted on each of the recording mechanisms, the switching mechanism configured to be controlled by at least one of a user, a measuring mechanism, and a signal to trigger the activation of one of the recording mechanisms;

wherein each of the recording mechanisms is configured, during a reactivation, to resume counting of a duration from a total duration recorded by a respective recording mechanism.

2. The instrument according to claim 1, wherein the total duration of various phases between a moment of general activation and a moment of general deactivation is displayed on a display.

3. The instrument according to claim 2, wherein the duration of at least one of the phases is displayed on a display by action on a second control mechanism which is identical or not to the first control mechanism.

4. The instrument according to claim 2, wherein the display comprises a first display unit on which at least one of the total duration of the various phases between a moment of general activation and a moment of general deactivation and the duration counted for each phase is displayed.

5. The instrument according to claim 4, wherein the display further comprises a second display unit on which a phase corresponding to the recording mechanisms is indicated.

6. The instrument according to claim 4, wherein the total duration of the various phases between the moment of general activation and the moment of general deactivation is displayed on the first display unit.

7. The instrument according to claim 2, wherein the display is digital.

8. The instrument according to claim 1, wherein the duration of at least one of the phases is displayed on a display by action on a second control mechanism which is identical or not to the first control mechanism.

9. The instrument according to claim 8, wherein the display comprises a first display unit on which at least one of the total duration of the various phases between a moment of general activation and a moment of general deactivation and the duration counted for each phase is displayed.

10. The instrument according to claim 1, wherein the instrument is a timepiece, and the timepiece includes a clock movement that is an electronic circuit.

11. The instrument according to claim 1, wherein the instrument comprises at least two recording mechanisms and a number of display units equal to a number of recording mechanisms on each of which the duration, which is counted by a recording mechanism when the recording mechanism is activated, is displayed.

12. The instrument according to claim 11, wherein the at least two display units are analog, each comprising a hand.

13. The instrument according to claim 1, wherein the general control mechanism is a push button.

14. The instrument according to claim 1, wherein the first control mechanism is a push button.

15. The instrument according to claim 1, wherein the selection mechanism is a rotatable element.

16. The instrument according to claim 15, wherein the rotatable element is a turning bezel of a timepiece.

17. The instrument according to claim 1, wherein the first control mechanism comprises at least one touch key.

18. The instrument according to claim 1, wherein the first control mechanism, by differentiated phase, in order, during a command for activation of one of the recording mechanisms, triggers deactivation of all the other recording mechanisms and saves the totality of the recorded time counted on each of the recording mechanisms.

19. The instrument according to claim 1, wherein the recording mechanisms are electronic counters.

20. The instrument according to claim 1, wherein the switching mechanism is acted on by both the first control mechanism and the selection mechanism.

21. A method for counting duration for differentiated phases with an instrument including a plurality of recording mechanisms to count time and to record a time duration, each actuatable, for activation and deactivation thereof, by a first control mechanism of the instrument, the method comprising:

selecting, in an inactive position where all the recording mechanisms are deactivated and via a selection mechanism which the instrument comprises, one of the recording mechanisms, the selection mechanism being a single actuator, and each of the recording mechanisms being selectable by the selection mechanism;

controlling, by action of a general control mechanism of the instrument, activation of the selected one of the recording mechanisms and displaying, on a display of the instrument, counting of a time duration provided by the selected one of the recording mechanisms;

actuating a switching mechanism of the instrument to control activation of one of the recording mechanisms, triggering deactivation of all the other recording mechanisms and saving of a totality of the recorded time counted on each of the recording mechanisms, and displaying, on the display, the counting of the duration of the activated one of the recording mechanisms, each of the recording mechanisms being configured, during a reactivation, to resume counting of a duration from a total duration recorded by a respective recording mechanism; and controlling the deactivation of all the recording mechanisms.

22. The method for counting a time duration according to claim 21, further comprising displaying, on the display, the duration of at least one of the phases by action on a second control mechanism which is identical or not to the first control mechanism.

23. The method for counting a time duration according to claim 21, further comprising displaying the total duration of the various phases between a moment of general activation and a moment of general deactivation and which is displayed on the display.

* * * * *